US007313927B2

(12) United States Patent
Barker

(10) Patent No.: US 7,313,927 B2
(45) Date of Patent: Jan. 1, 2008

(54) PORTABLE SOFT SHELL COOLER WITH COMPARTMENTED RACK FOR INDIVIDUAL MEAL AND BEVERAGE CONTAINERS

(76) Inventor: Garen S. Barker, 315 Johnson Ave., Apt. B-9, Cape Canaveral, FL (US) 32920

( * ) Notice: Subject to any disclaimer, the term of this patent is extended or adjusted under 35 U.S.C. 154(b) by 0 days.

(21) Appl. No.: 10/832,835

(22) Filed: Apr. 26, 2004

(65) Prior Publication Data

US 2007/0186579 A1 Aug. 16, 2007

(51) Int. Cl.
*F25D 3/08* (2006.01)

(52) U.S. Cl. ..... 62/457.2

(58) Field of Classification Search ..... 62/457.2, 62/457.3, 457.4, 457.7, 371, 530
See application file for complete search history.

(56) References Cited

U.S. PATENT DOCUMENTS 5,873,504 A * 2/1999 Farmer ..... 224/576

* cited by examiner

*Primary Examiner*—Melvin Jones
(74) *Attorney, Agent, or Firm*—Donald W. Meeker

(57) ABSTRACT

A soft thermally insulated padded shell houses a rigid rack with a series of vertical walls forming compartments. One pair of walls has a series of mating horizontal tracks to receive slide-in meal containers in a spaced vertical array. Narrow side compartments house coolant containers. Another compartment houses beverage containers. Upper holes in the walls admit air flow between compartments. A vertical lip on the open front edge of the bottom of the rack forms a condensation basin beneath the elevated meal containers. An elevated floor section insertable in the beverage compartment serves as a beverage compartment condensation basin. Holes through the bottoms of the walls allow condensation water circulation between compartments.

9 Claims, 6 Drawing Sheets

PORTABLE SOFT SHELL COOLER WITH COMPARTMENTED RACK FOR INDIVIDUAL MEAL AND BEVERAGE CONTAINERS

BACKGROUND OF THE INVENTION

1. Field of the Invention

The present invention relates to portable, insulated, carrying devices useful for storing, conveying and serving food and beverages, and specifically to a soft-sided cooler assembly which has an insertable rigid frame rack with compartments that hold slide-in individual meal containers, beverage containers, ice packs, and with an internal air circulation system, zippered side access openings, and a condensation collection basin.

2. Description of the Prior Art

While one purpose of storing food and beverages in a cooler is to keep them cool, another equally important and related purpose is to preserve the food and beverages during their storage. In an effort to preserve a cooler's contents, it is generally preferable that the contents leave the cooler in almost as good a condition as that in which they were when they entered the cooler. A lack of sufficient and consistent cooling, excessive movement, excessive pressure and excessive moisture are, for example, four conditions that may damage the contents of a cooler, possibly making the contents completely undesirable. In this context, pressure refers to the force of one cooler item, such as a bottle, against another, such as a sandwich.

The prior art patents have not adequately addressed the problems relating to preserving the condition of the food in the cooler.

U.S. Pat. No. 6,039,202, issued Mar. 21, 2000 to Olstad, puts forth a cooler insert system that includes an open-sided, main frame structure including an end wall and two opposed side walls, the end wall and the two opposed side walls each having an opening formed therethrough, the two opposed side walls having three pairs of divider screen guide channels; a snap fit, hinged frame panel that is simultaneously snap fittable to an end of each of the two opposed sidewalls of the frame structure to form an open topped box with the main frame structure; three divider screens, each divider screen being insertable into one pair of the three pairs of divider screen guide channels of the main frame structure to divide the interior of the main frame structure into compartments; and a number of stackable trays that are positionable within a compartment formed by one of the divider screens, each stackable tray having a holding cavity defined therein that is accessible through an access opening and a lower registration protrusion extending from the bottom thereof; the registration protrusion being sized and shaped to sealing fit into the access opening of a holding cavity of another tray member and to seal the access opening into the holding cavity.

U.S. Pat. No. 5,501,338, issued Mar. 26, 1996 to Preston, provides a food carrier that comprises a plurality of stacked, interchangeable rigid food tray assemblies, at least one of the tray assemblies having a plurality of compartments formed therein. A strap secures the stacked food tray assemblies to each other. The strap comprises a handle for carrying the food carrier. A thermally insulative cover is provided for the outside of the food tray assemblies for stabilizing the temperature of any food contained therein.

U.S. Pat. No. 5,842,571, issued Dec. 1, 1998 to Rausch, describes a compartmentalized soft-sided container that includes a beverage compartment disposed in front of a warm compartment and a cool compartment. A pair of removable insulating interior walls are attachable to the interior of the container to divide the container into the individual compartments. The beverage compartment includes an adjustable closure that is capable of tightly securing differently-sized beverage containers by providing a flexible sheet having a drawstring that allows the height and opening of the closure to be adjusted. The drawstring may also be used to cinch about the neck of a beverage container to securely hold it in container. The container is also tapered such that compartments snugly retain articles such as soup bowls to prevent spilling.

U.S. Pat. No. 5,445,276, issued Aug. 29, 1995 to Gordon, concerns a removable food container attachment for lunch pails and small coolers, which includes a sling member formed of flexible material having a bottom wall and opposed end portions and side portions extending upwardly therefrom to define a generally rectangular compartment which receives one or more bowl-shaped food containers each having an air tight lid. In a preferred embodiment, the bottom and sides of the compartment are of double wall construction and filled with thermally insulating material. A flexible insulating cover removably received on the top of the covered food container encloses the top end of the sling compartment. The sling compartment with the insulating cover installed is placed on the bottom of a conventional lunch pail or small cooler. A flexible strap connected to one side portion extends over the top of the pail or cooler and a releasable fastener connected with the strap and with the other side portion releasably secures the sling onto the pail or cooler and the assembly is conveniently carried as a single unit. One or more small pockets may be provided on the exterior of the sling for holding eating utensils and other items. Conventional covered food containers, microwaveable dishes, or one or more conventional frozen dinner packages may be carried in the sling compartment. Wholesome plate lunches prepared in advance may be placed in containers, stored in an refrigerator or freezer, transported in the attachment, and when desired, microwaved for consumption.

U.S. Pat. No. 2,184,336, issued Dec. 16, 1939 to Devine, provides a thermally insulated lunch box with an outer casing and an inner casing. The inner casing is adapted to receive a plurality of nested food tanks.

U.S. Pat. No. 2,147,886, issued Feb. 21, 1939 to Devine, shows a lunch box that comprises an outer casing, an inner casing thermally insulated from the outer casing and a plurality of superposed food tanks, which are disposed within and held in a spaced relation to the inner casing and thermally insulated therefrom.

U.S. Pat. No. 2,623,656, issued Dec. 30, 1952 to Rottau, illustrates a picnic server that comprises a plurality of food containers that are in a stacked arrangement, so that the bottom of one container provides that cover for the container below it. A lid is provided for the top container. The food containers are firmly secured together by a series of yokes.

U.S. Pat. No. 6,595,604, issued Jul. 22, 2003 to Peterson, provides a tray support system for a bag, which has an internal compartment with an access opening in the front wall. The tray support system includes a pair of opposing tray support brackets attached to opposing vertical side walls of the internal compartment. Each of the pair of brackets has a plurality of ledges that are horizontally aligned to form complementary ledges that receive and support the outer edges of a tray. The tray support brackets may be releasably attached directly to the side walls of the compartment, or attached to rigid inserts which are in turn attached to the side walls. When the trays are not in use, the space in the compartment is substantially unobstructed and can be used to store various items. Also, the brackets and inserts are easily and conveniently removably so that the bag may be folded for storage.

U.S. Pat. No. 2,870,904, issued Jan. 27, 1959 to Tarbox, puts forth a metal physician's bag with a plurality of trays that may be selectively withdrawn from the case. The trays may be removed for sterilization purposes. The physician may keep pre-sterilized trays in his car and restock his bag at any time.

U.S. Pat. No. 6,612,434, issued Sep. 2, 2003 to Redzisz, shows a sport tackle box bag for carrying multiple rectangular parallelepiped generally rigid tackle storage boxes. The box bag includes a lower section having a front flap for access to the lower section and an upper section having a top flap for access to the top section.

U.S. Pat. No. 5,630,537, issued May. 20, 1997 to Sciacca, is for a compartmentalized box and a knapsack incorporating the same. The knapsack has straps allowing carrying of the compartmentalized box on a person's back. The compartmentalized box has columns formed of a plurality of panels for supporting a plurality of containers and for allowing the containers to be slid in and out of the compartmentalized box. Edgewise adjacent ones of the panels can be disconnected from each other and the panels rearranged to allow containers of differing sizes to be slid into the compartmentalized box so that the knapsack can be readily restocked with any desired arrangement of the containers.

U.S. Patent Application 20020084206, published Jul. 4, 2002 by Protopapas, depicts a lunch box that comprises a plurality of stackable, interchangeable food tray assemblies that have compartments in them for the storage of foodstuffs and other items. These stackable, interchangeable food tray assemblies are housed in an enclosure with a lid to protect the contents and a handle to provide ease of transport by the user. The lunch box can be made in a variety of sizes to accommodate the needs of the user and to fit within various size refrigerators. The lunch box can include locking features to hinder unauthorized access to the contents.

U.S. Pat. No. 5,403,095, issued Apr. 4, 1995 to Melk, claims a flexible cooler with a removable insert, which is a thermally insulating carrier for preventing temperature change of heated or cooled items placed therein. The carrier includes a flexible bag-like container having a compartment therein and a generally rigid hollow tub-like liner member which is removably disposed in the compartment. The flexible container includes a side wall portion, a base portion, and a displaceable cover. At least the side wall portion and cover are constructed incorporating a flexible insulating material for providing an insulating effect. The side wall portion is joined with the base portion and together with the cover define the compartment. A container aperture is defined by a top edge of the side wall portion. A closing device is attached to the container aperture and a perimeter of the cover for releasably retaining the cover over the container aperture. The hollow liner is integrally formed of a rigid, waterproof, and shatterproof material with side portions joined to a bottom portion. A mouth is formed around the top of the liner and is coincident with the container aperture. The liner improves the thermal characteristics, provides structural support for the flexible container, and prevents leakage of moisture from the flexible container.

U.S. Pat. No. 5,216,900, issued Jun. 8, 1993 to Jones, discloses a soft-sided cooler that has a pivotably fastenable lid and a soft-sided coolant pack dimensioned to fit snugly within the underside region of the lid. The underside region is defined by a plurality of generally opposing, inwardly facing sidewalls that extend downward towards the cooler body for fastening thereto when the lid is closed. The cooling pack comprises a matrix of coolant cells integrally formed within a compliant plastic sheet, and inserted within a fabric envelope. The envelope, in turn, bears Velcro™ fastening material which releasably retain the envelope within the underside of the lid by mating with Velcro™ surfaces on at least a generally opposing pair of the sidewalls.

It is desirable to have a cooler assembly that improves the management of the cooler's contents by managing the cooling, movement, pressure and/or moisture within the cooler. The contents of a cooler may sustain less degradation during storage in the cooler if the cooler assembly incorporates improved content management. Insofar the content of a cooler generally includes, for example, food, beverages, and coolants, a desirable cooler assembly would store the food, beverages, and coolants in a manner that would improve cooling, reduce movement, relieve pressure and/or isolate moisture within the cooler.

What is needed is a soft-shell insulated cooler having an insertable frame rack with compartments that hold slide-in individual meal containers, beverage containers, and ice packs, and with an internal air circulation system and a condensation collection basin with the ability to separate and carry individual meal container trays and beverage containers for people who need to eat frequently, such as weight lifters, diabetics and patients having had stomach surgery or to provide separate meals for a family outing.

SUMMARY OF THE INVENTION

An object of the present invention is to provide a soft-shell insulated cooler assembly having an insertable rigid frame rack having a framed meal compartment with a vertically stacked array of tracks to hold and separate slide-in individual meal containers and framed compartments that hold beverage containers and ice packs, and an internal air circulation system and a condensation collection basin to improve the management of the cooler's contents and store the food, beverages, and coolants in a manner that would improve cooling, reduce movement, relieve pressure and/or isolate moisture within the cooler so that the contents of the cooler may sustain less degradation during storage in the cooler.

Another object of the present invention is to provide a cooler with the ability to separate and carry individual meals for people who need to eat frequently, such as weight lifters, diabetics and patients having had stomach surgery or to provide separate meals for a family outing.

One more object of the present invention is to provide individual vertically arrayed tracks for each of the meal container trays to separate them and individual framed slots for the beverage containers and the coolant containers to separate them and prevent them from pressing on the meal containers.

An additional object of the present invention is to provide built-in air slots in the surfaces of the containers and in all of the frame members as well as elevating the bottom support surface of the frame rack to provide complete air circulation throughout the interior of the cooler and provide a moisture condensation basin on the bottom support surface formed by an elevated lip around the bottom support surface.

A further object of the present invention is to provide a waterproof shell with built-in layers of thermal insulation to prevent external heat or moisture from affecting the interior of the cooler.

In brief, a soft-shell insulated cooler has an outer waterproof shell with padded layers of insulation and an insertable rigid frame rack to fit within the shell with a food compartment having a vertical array of mating horizontal slots that hold slide-in individual separated meal containers having trays and covers and framed vertical slots for beverage containers and ice packs separated from the food containers to prevent them from pressing against the food containers.

An internal air circulation system comprises openings in the frame rack between all frame walls separating compartments and air slots around the meal containers and coolant containers with air slots built into the tops, bottoms, and sides of the containers to permit air circulation between and around the containers. The rigid frame rack has a slightly elevated bottom edge around the bottom support surface to form a condensation collection basin under the elevated meal containers. An elevated floor section under the beverage containers serves as a condensation collection basin in the beverage compartment.

Zippered side access pockets on the outside of the shell provide closed storage compartments for eating utensils, napkins, or other items.

A full front zippered insulated opening enables full access to the contents for sliding food tray containers in and out and for accessing beverage containers and coolant containers.

An advantage of the present invention is that it improves the management of the contents and stores the food, beverages, and coolants in a manner that would improve cooling, reduce movement, relieve pressure and/or isolate moisture within the cooler so that the contents of the cooler may sustain less degradation during storage in the cooler.

Another advantage of the present invention is that it provides a cooler with the ability to separate and carry individual meals for people who need to eat frequently, such as weight lifters, diabetics and patients having had stomach surgery or to provide separate meals for a family outing.

One more advantage of the present invention is that it provides framed separations between the meal containers, beverage containers, and coolant containers to separate them and prevent them from pressing on each other.

An additional advantage of the present invention is that it provides complete air circulation throughout the interior of the cooler and a moisture condensation space for proper cooling of all the contents and to prevent any food from getting soggy due to condensed moisture.

A further advantage of the present invention is that it prevents external heat or moisture from affecting the interior of the cooler.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
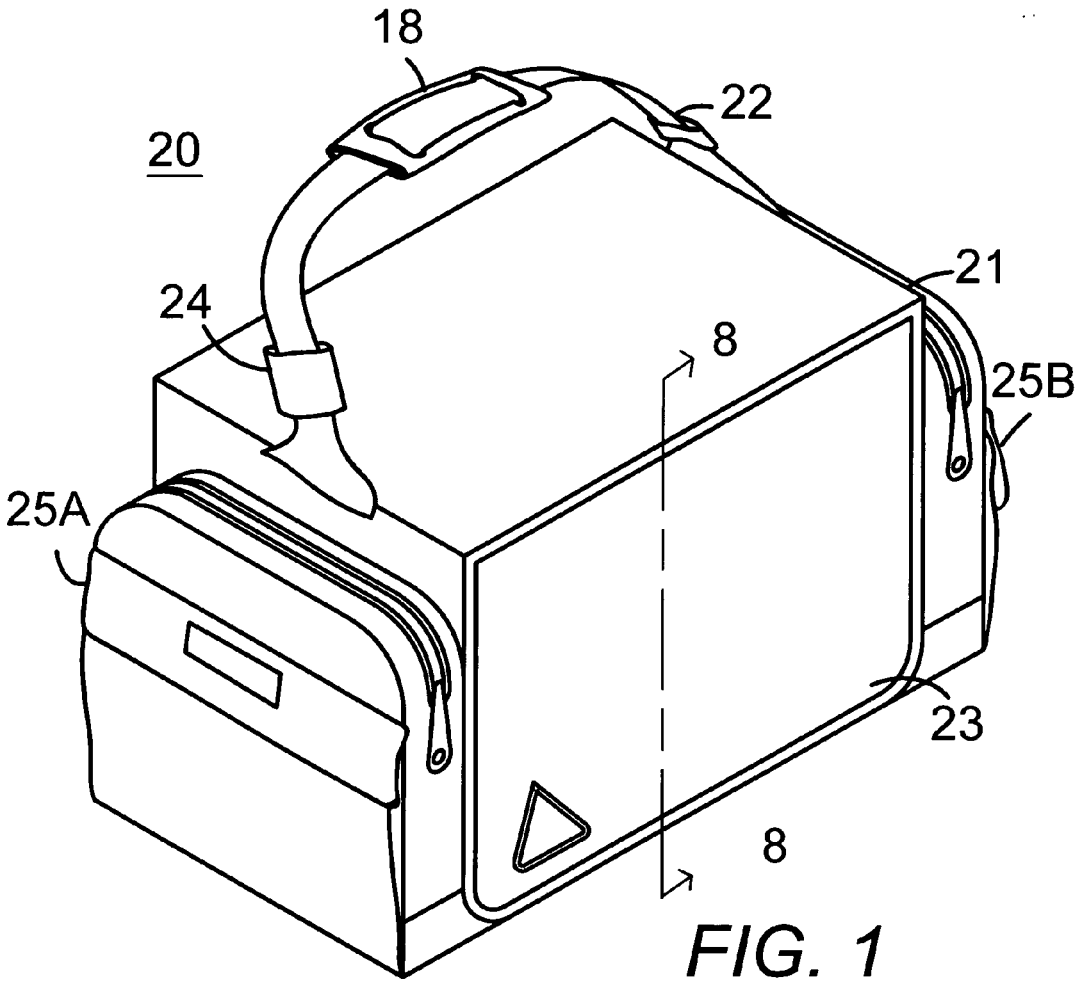
FIG. 1 is a perspective view of the outside of the soft shell insulated portable cooler of the present invention showing the front opening, the side zipper pockets, and the carrying strap.

In FIGS. 1-9, a portable cooler device 20 for storing and transporting individual meal containers 31 and beverage containers 37 comprises a soft padded thermally insulated external shell 21 and an inner rigid frame rack 30.

Figure 2:
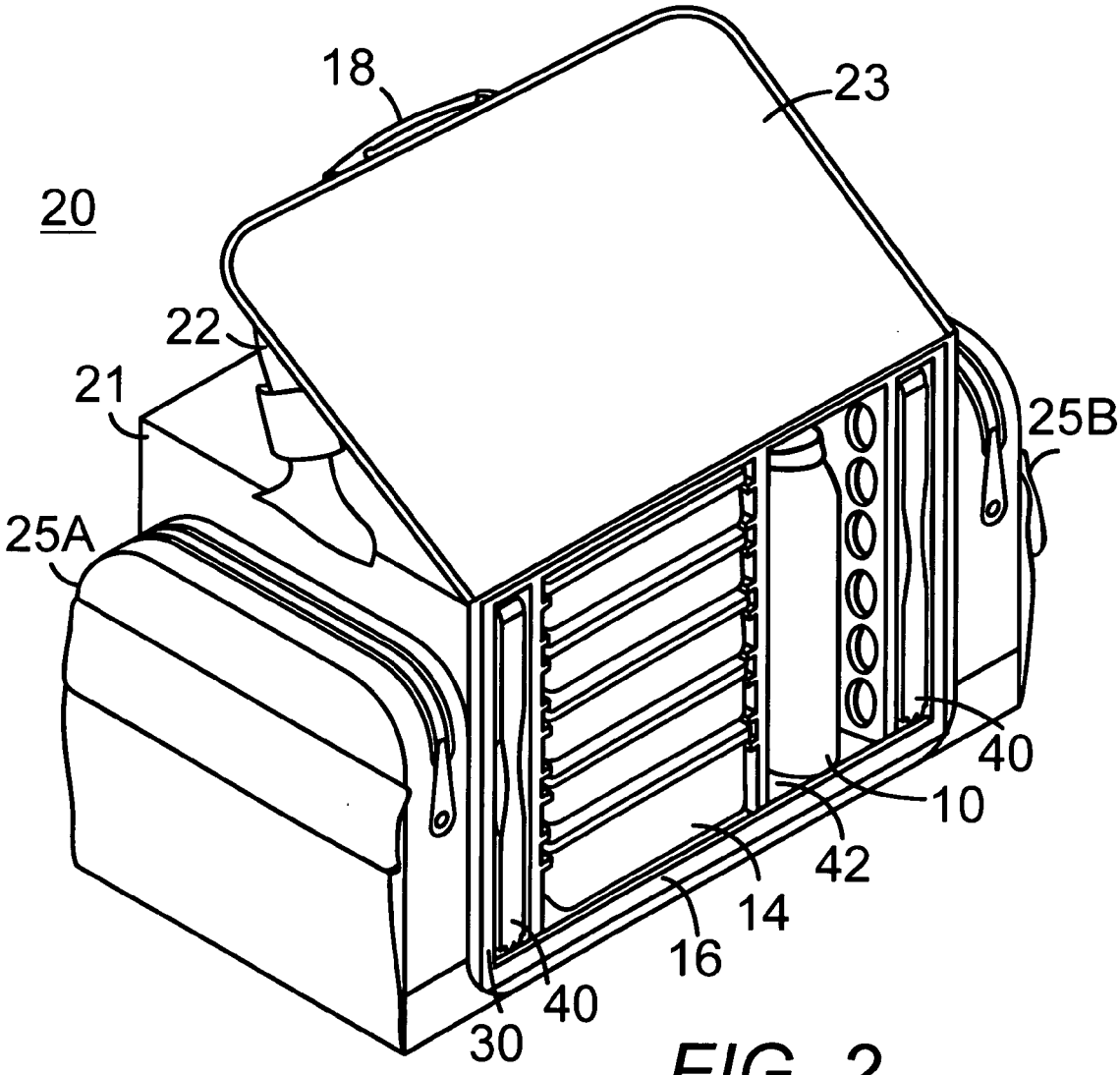
FIG. 2 is a perspective view of the outside of the soft shell insulated portable cooler of FIG. 1 showing the front opening up with the entire contents of the interior of the cooler accessible.
Figure 8:
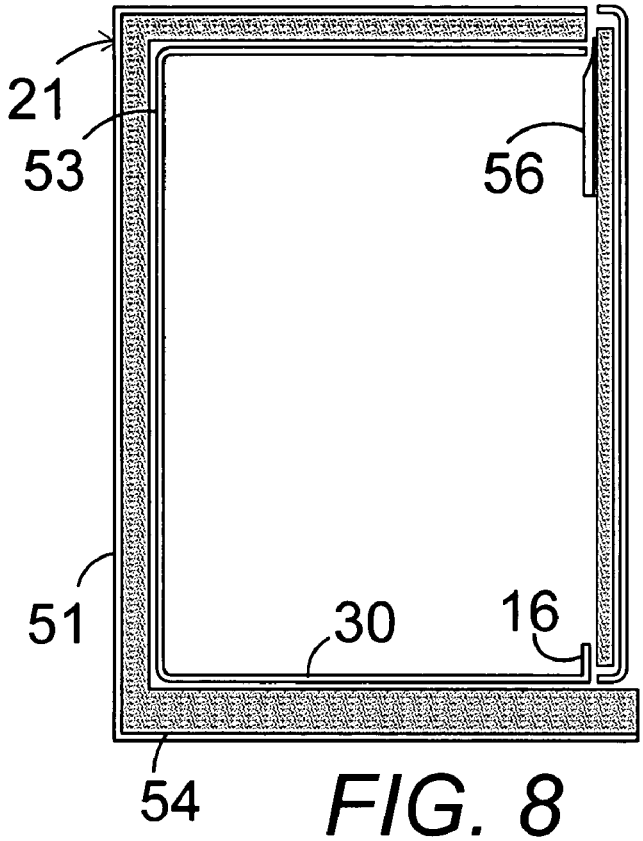
FIG. 8 is a transverse cross-sectional view of the cooler taken through 8-8 of FIG. 1 showing the thermal insulation in the padded soft shell and the opening.

In FIGS. 1, 2, 8, and 9, the outer soft shell 21 has a nylon outer layer 51; a padded layer of thermal insulation material 54, such as a thermal foam, an inner PVC backed foil lining 53, or colored PVC, as seen in FIG. 8. The shell has a front opening extending over the entire front of the shell. A front cover panel 23 is adapted for opening to access the interior of the shell and adapted for closing with an airtight seal using a zipper, mating hook and loop fasteners or other means around the two sides and the bottom edge with the top edge 18 sewn to the top of the shell to form a flexible hinge-type connection to enable the panel 23 to open upwardly, as shown in FIG. 2. to allow complete access to the interior. The front cover panel 23 covers the entire front opening.

Figure 9:
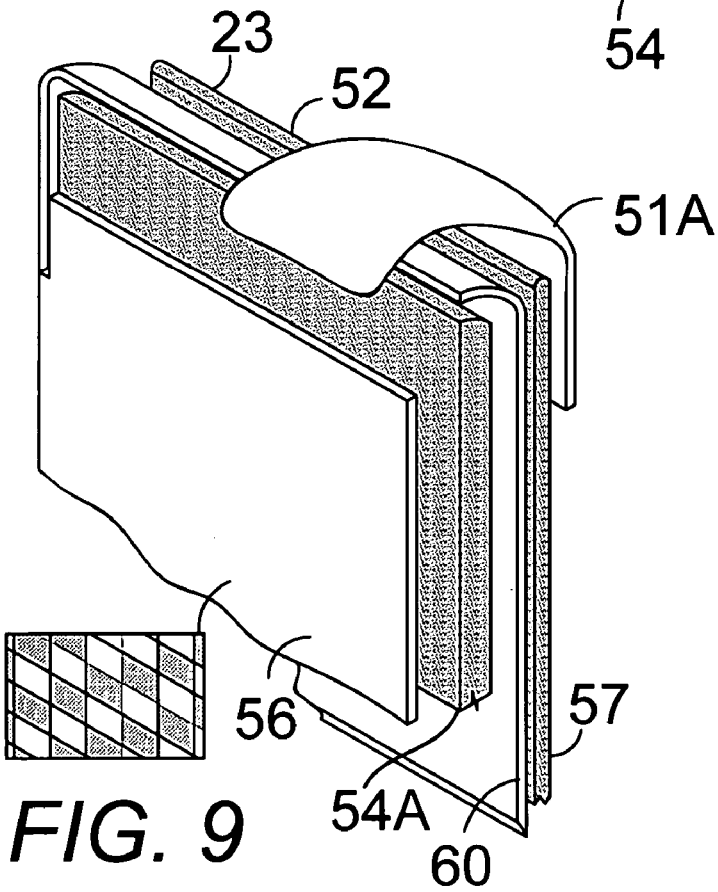
FIG. 9 is an exploded partial perspective view of the front opening of the cooler showing the layers of thermal insulation and padding.

In FIGS. 8 and 9, the front cover panel 23 preferably comprises an outer layer 51A of nylon or other durable material, a two thermal insulating foam layers 57 and 54A sandwiching a plastic insert sheet 60 between the layers for stiffness. An interior layer 56 of PVC backed or foil type material preferably covers at least a portion of the front cover panel along with an inner layer 51A similar to the outer layer and preferably contiguous with the outer layer of nylon or other durable material.

In FIGS. 1 and 2, a nylon or other type of strap 22 may have a padded contact sleeve 18 and snap on clips 24 as a means for carrying the device, preferably as a shoulder strap. Preferably two zippered side storage pockets 25A and 25B are located on the outside of the shell, with one at each end, for storing eating utensils, napkins, or other items.

In FIGS 2, 3, 7, and 8, the rigid frame rack 30, preferably fabricated of a durable plastic, is adapted to be inserted within the shell 21. The rack 23 comprises a top surface 61, a bottom surface 65, a back surface 62 with vertical stop rails 63 in the meal container compartment 38, and a pair of side walls 64A and 64B on the exterior of the rack with an open front. A series of vertical walls 66, 67, and 68 extending from the open front of the rack to a back of the rack form a series of compartments, a meal container compartment 38, a beverage container compartment 39, and two end coolant container compartments 36A and 36B formed between the side walls 64A and 64B of the rack 23 and two of the series of interior walls 66 and 68, respectively.

The series of vertical walls 66, 67, and 68 each have a multiplicity of openings 19, 19A, and 19B therethrough to admit air circulation between adjacent pairs of the series of compartments. At least one first pair of adjacent vertical walls 66 and 67 form a meal container compartment 38 between facing sides of the vertical walls. A series of mating horizontal tracks 37 run from the open front of the rack to the back of the rack in a vertical array on each of the facing sides.

Figure 3:
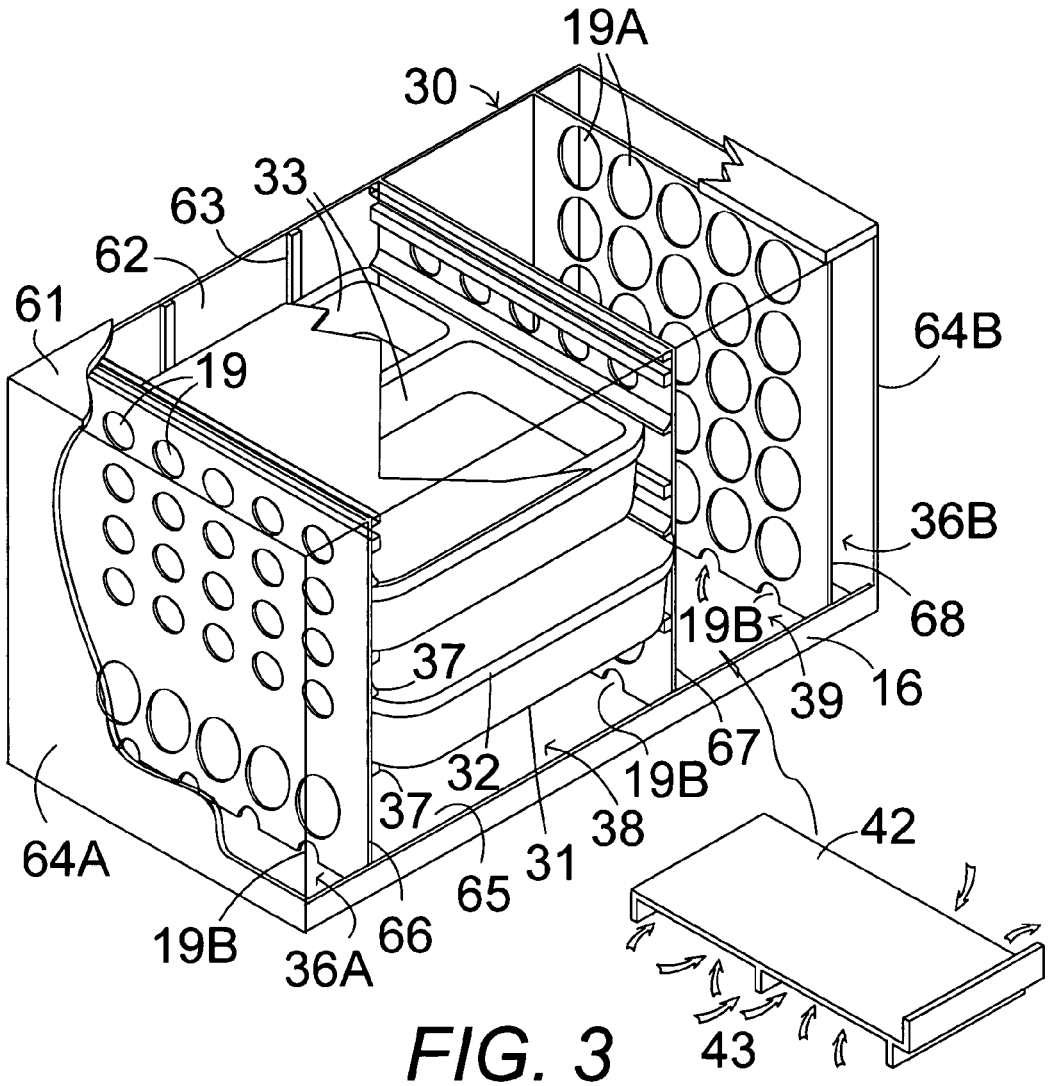
FIG. 3 is a perspective view of the rigid frame rack insertable inside the outer soft shell of the cooler showing the various framed compartments and airflow and waterflow openings through the frame walls separating the framed compartments and showing two meal containers in place in separate tracks of the rack, and including an elevated floor insertable under the beverages in the beverage holding framed compartment.
Figure 4:
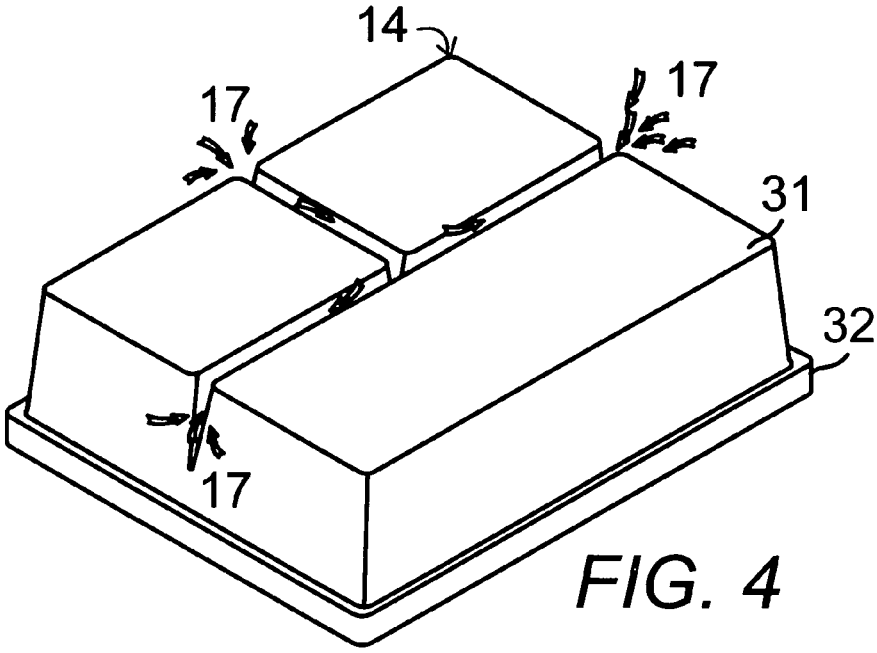
FIG. 4 is a perspective view of the bottom of a meal container with the built-in slots for air circulation.

In FIGS. 2, 3, 4, and 7, a series of meal containers 14 each comprising a tray 31 for containing a meal therein and a cover 32 engaging the tray with an airtight seal are adapted for sliding removably on the pairs of horizontal tracks 37 in a vertical array with each of the adjacent meal containers spaced apart from each adjacent container. Each of the trays has a pattern of recessed channels 17 in a bottom of the tray, as shown in FIG. 4, the pattern of recessed channels forming air circulation paths on an exterior of the tray and forming food separators on an interior of the tray.

A second pair of adjacent vertical walls 67 and 68 form a compartment 39 for receiving beverage containers 10. In FIGS. 2 and 3, an elevated floor section 42 is insertable in the beverage container compartment 39 under the beverage containers 10 with a flowthrough space 43 underneath to function as a condensation collection basin in the beverage compartment.

Each of the series of vertical walls 66, 67, and 68 is formed of a rigid material to prevent containers in one compartment from pressing against containers in adjacent compartments.

Figure 5:
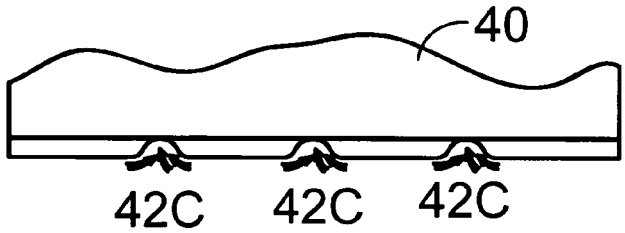
FIG. 5 is a partial side elevational view of a coolant container showing the transverse air and water circulation slots spaced along the bottom.
Figure 6:
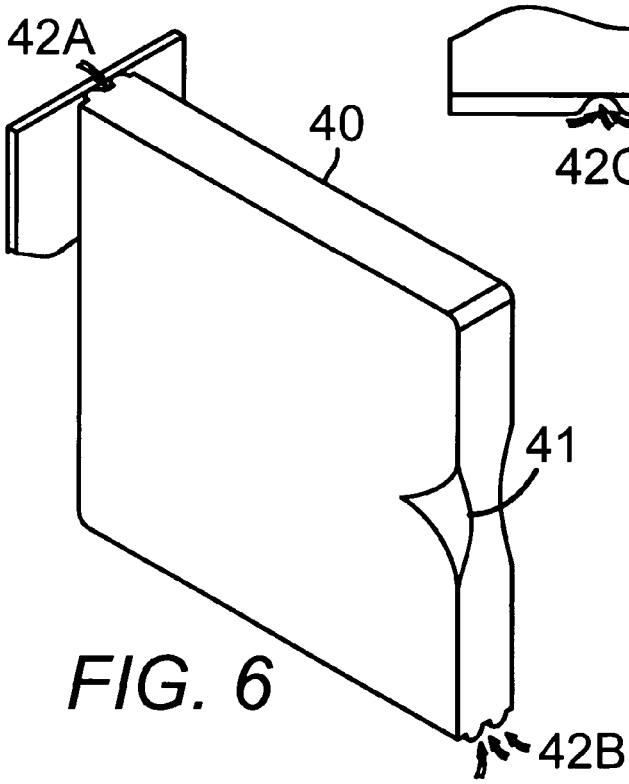
FIG. 6 is a perspective view of a coolant container showing bottom longitudinal built-in air and water circulation slots and back edge longitudinal air circulation slots and front edge grasping recess.
Figure 7:
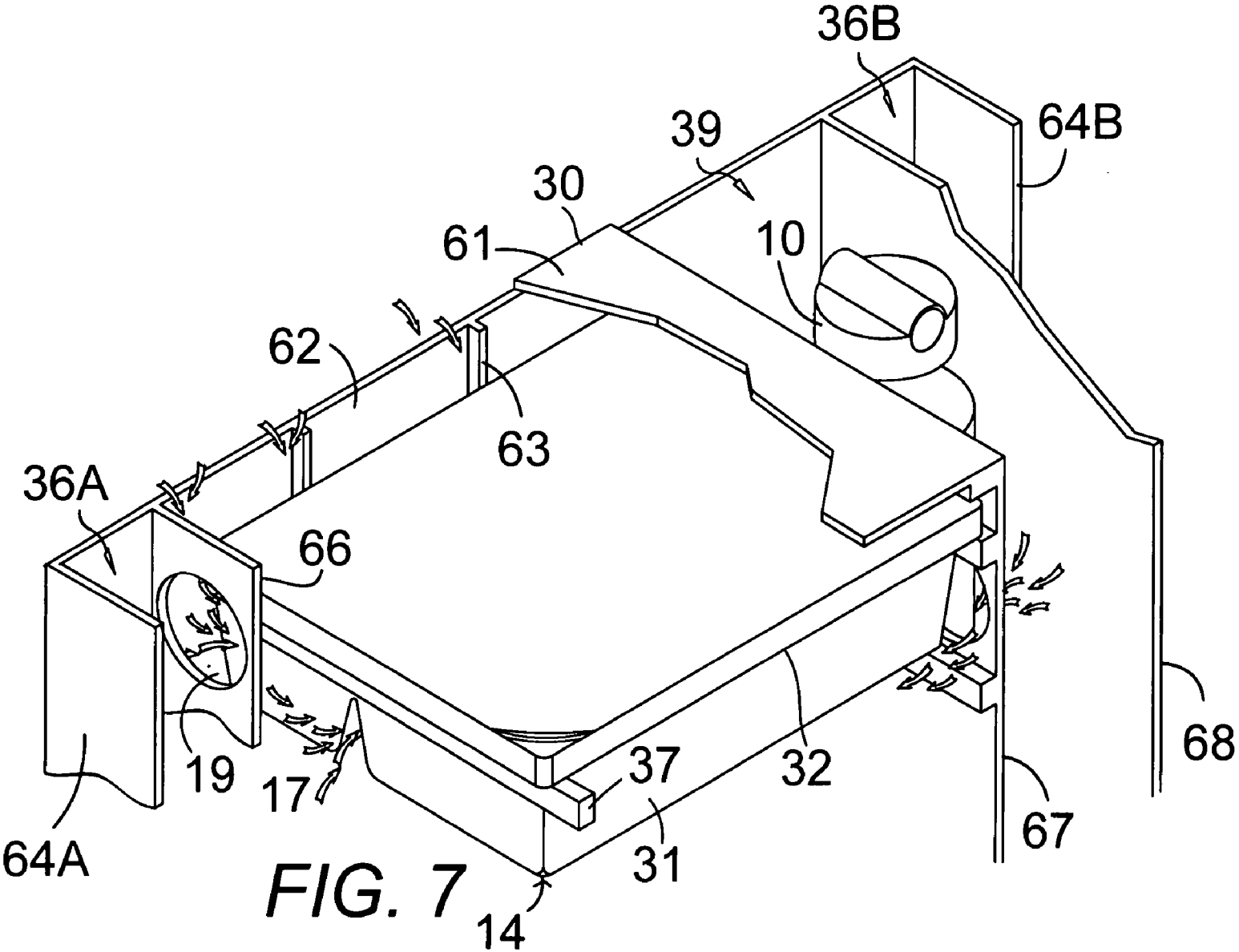
FIG. 7 is a broken partial perspective view of the frame rack with portions broken away to show a meal container and a beverage container in their respective compartments.

In FIGS. 2, 5, and 6, a pair of coolant containers 40 are adapted to fit within the two side compartments of the rack 36A and 36B. Each of the pair of coolant containers has a series of transverse horizontal recessed channels 42C in a bottom edge, as seen in FIG. 5, and a series of longitudinal horizontal recessed channels 42B in the bottom edge, as seen in FIG. 6, and a series of longitudinal vertical recessed channels 42A in a back edge for allowing air circulation through the recessed channels. The coolant containers 40 also have front recessed gripping notches 41 to assist in grasping the coolant containers during insertion and removal.

In FIGS. 2 and 3, the meal containers 14 are elevated above-the bottom 65 of the rack and the rack further comprises an elevated edge 16 along the edge of the bottom of the rack forming a condensation collection basin under the meal containers.

In FIG. 3, the series of vertical walls 66, 67, and 68 each has a series of bottom openings 19B therethrough to circulate air and condensation water therethrough.

In use, as seen in FIG. 2, the front opening 23 opens all the way from the front opening of the rack 21 for insertion and removal of the rack 30 and insertion and removal of the coolant containers 40, individual meal containers 14 and beverage containers 10. In FIG. 1, the front opening 23 may be zipped closed and the strap 22 slung over the shoulder for carrying the cooler device 20.

It is understood that the preceding description is given merely by way of illustration and not in limitation of the invention and that various modifications may be made thereto without departing from the spirit of the invention as claimed.

What is claimed is:

1. A portable cooler device for storing and transporting individual meals and beverages, the device comprising:

an outer soft shell with at least one padded layer of thermal insulation material, a means for carrying the device comprising an adjustable shoulder strap removably attached to the shell, and a front cover panel adapted for opening to access the interior of the shell and adapted for closing with an airtight seal;

a rigid frame rack adapted to be inserted within the shell, the rack comprising at least a top and a bottom and a pair of side walls on the exterior of the rack with an open front and a series of vertical walls from the open front of the rack to a back of the rack forming a series of compartments separated by the series of vertical walls, the series of vertical walls each having a multiplicity of openings therethrough to admit air circulation between adjacent pairs of the series of compartments, at least one first pair of adjacent vertical walls forming a meal container compartment between facing sides of the at least one first pair of adjacent vertical walls, a series of mating horizontal tracks running from the open front of the rack to the back of the rack in a vertical array on each of the facing sides, a single vertical wall spaced apart from a side wall on each side of the rack to form a compartment on each side of the rack for receiving a coolant container, and at least one second pair of adjacent vertical walls forming a compartment for receiving beverage containers, each of the series of vertical walls being formed of a rigid material to prevent containers in one compartment from pressing against containers in adjacent compartments;

a series of meal containers each comprising a tray for containing a meal therein and a cover engaging the tray with an airtight seal, the series of meal containers adapted for sliding removably on the pairs of horizontal tracks in a vertical array with each of the adjacent meal containers spaced apart from each adjacent container, each of the trays having a pattern of recessed channels in a bottom of the tray, the pattern of recessed channels forming air circulation paths on an exterior of the tray and forming food separators on an interior of the tray;

a pair of coolant containers adapted to fit within the two side compartments of the rack, each of the pair of coolant containers having a series of recessed channels in a top edge and a bottom edge and a back edge for allowing air circulation through the recessed channels.

2. A portable cooler device for storing and transporting individual meals and beverages, the device comprising:

an outer soft shell with at least one padded layer of thermal insulation material, a means for carrying the device, and a front cover panel adapted for opening to access the interior of the shell and adapted for closing with an airtight seal;

a rigid frame rack adapted to be inserted within the shell, the rack comprising at least a top and a bottom and a pair of side walls on the exterior of the rack with an open front and a series of vertical walls from the open front of the rack to a back of the rack forming a series of compartments separated by the series of vertical walls, the series of vertical walls each having a multiplicity of openings therethrough to admit air circulation between adjacent pairs of the series of compartments, at least one first pair of adjacent vertical walls forming a meal container compartment between facing sides of the at least one first pair of adjacent vertical walls, a series of mating horizontal tracks running from the open front of the rack to the back of the rack in a vertical array on each of the facing sides, a single vertical wall spaced apart from a side wall on each side of the rack to form a compartment on each side of the rack for receiving a coolant container, and at least one second pair of adjacent vertical walls forming a compartment for receiving beverage containers, each of the series of vertical walls being formed of a rigid material to prevent containers in one compartment from pressing against containers in adjacent compartments;

a series of meal containers each comprising a tray for containing a meal therein and a cover engaging the tray with an airtight seal, the series of meal containers adapted for sliding removably on the pairs of horizontal tracks in a vertical array with each of the adjacent meal containers spaced apart from each adjacent container, each of the trays having a pattern of recessed channels in a bottom of the tray, the pattern of recessed channels forming air circulation paths on an exterior of the tray and forming food separators on an interior of the tray, the meal containers being elevated above the bottom of the rack and the rack further comprises an elevated edge around the bottom of the rack forming a condensation collection basin under the meal containers;

a pair of coolant containers adapted to fit within the two side compartments of the rack, each of the pair of coolant containers having a series of recessed channels in a top edge and a bottom edge and a back edge for allowing air circulation through the recessed channels.

3. The device of claim 2 wherein the series of vertical walls each has a series of bottom openings therethrough to circulate air and condensation water therethrough.

4. A portable cooler device for storing and transporting individual meals and beverages, the device comprising:

an outer soft shell with at least one padded layer of thermal insulation material, a means for carrying the device, and a front cover panel adapted for opening to access the interior of the shell and adapted for closing with an airtight seal;

a rigid frame rack adapted to be inserted within the shell, the rack comprising at least a top and a bottom and a pair of side walls on the exterior of the rack with an open front and a series of vertical walls from the open front of the rack to a back of the rack forming a series of compartments separated by the series of vertical walls, the series of vertical walls each having a multiplicity of openings therethrough to admit air circulation between adjacent pairs of the series of compartments, at least one first pair of adjacent vertical walls forming a meal container compartment between facing sides of the at least one first pair of adjacent vertical walls, a series of mating horizontal tracks running from the open front of the rack to the back of the rack in a vertical array on each of the facing sides, a single vertical wall spaced apart from a side wall on each side of the rack to form a compartment on each side of the rack for receiving a coolant container, and at least one second pair of adjacent vertical walls forming a compartment for receiving beverage containers, each of the series of vertical walls being formed of a rigid material to prevent containers in one compartment from pressing against containers in adjacent compartments;

a series of meal containers each comprising a tray for containing a meal therein and a cover engaging the tray with an airtight seal, the series of meal containers adapted for sliding removably on the pairs of horizontal tracks in a vertical array with each of the adjacent meal containers spaced apart from each adjacent container, each of the trays having a pattern of recessed channels in a bottom of the tray, the pattern of recessed channels forming air circulation paths on an exterior of the tray and forming food separators on an interior of the tray;

a pair of coolant containers adapted to fit within the two side compartments of the rack, each of the pair of coolant containers having a series of recessed channels in a top edge and a bottom edge and a back edge for allowing air circulation through the recessed channels;

wherein the shell has a front opening extending over the entire front of the shell to admit the rack and allow access to the rack and the front cover panel covers the entire front opening.

5. The device of claim 4 wherein the front cover panel attaches with a permanent connection along a top edge of the front cover panel and a top edge of the front opening of the shell and the front cover panel removably attaches to a bottom and two sides of the front opening of the shell by a means for forming an airtight closure between the shell and the front cover panel.

6. The device of claim 4 wherein the means for forming an airtight closure comprises a zipper.

7. The device of claim 2 further comprising an elevated floor section insertable in the beverage container compartment under the beverage containers to function as a condensation collection basin in the beverage compartment.

8. The device of claim 1 further comprising at least one zippered side storage pocket on the outside of the shell.

9. The device of claim 4 wherein the means for carrying the device comprises an adjustable shoulder strap removably attached to the shell.

* * * * *